United States Patent [19]

Hodge, Jr. et al.

[11] Patent Number: 5,056,439

[45] Date of Patent: Oct. 15, 1991

[54] BACKPACKER'S CAMP TABLE

[76] Inventors: William G. Hodge, Jr.; William G. Hodge, III, both of 1215 Northlake, Richardson, Tex. 75080

[21] Appl. No.: 499,177

[22] Filed: Mar. 26, 1990

[51] Int. Cl.[5] ..... A47B 3/00

[52] U.S. Cl. ..... 108/34; 248/165

[58] Field of Search ..... 108/25, 34, 35, 38, 108/157; 248/165; 297/440, 441; 5/114, 289; 211/177

[56] References Cited

U.S. PATENT DOCUMENTS

| | | | |
|---|---|---|---|
| 589,947 | 9/1897 | Jensen | 248/165 |
| 1,071,834 | 9/1913 | Wall | 108/50 |
| 3,708,143 | 1/1973 | Schletz | 248/165 |

FOREIGN PATENT DOCUMENTS

| | | | |
|---|---|---|---|
| 2596823 | 10/1987 | France | 297/440 |
| 0003515 | 2/1902 | United Kingdom | 5/114 |

*Primary Examiner*—Kenneth J. Dorner
*Assistant Examiner*—G. Anderson
*Attorney, Agent, or Firm*—Ross, Howison, Clapp & Korn

[57] ABSTRACT

A portable table includes a pair of side members and a pair of end members. Structure is provided for detachably interconnecting the side members and the end members to thereby form a table frame. A plurality of support members are detachably interconnected to the side members for supporting the table frame above a surface. Each of the support members includes first and second ends. The first ends thereof are detachably interconnected to the pair of side members, and the second ends thereof extend to the surface. The support members second ends are spaced apart greater than the length of the end members and greater than the length of the side members for generating a torque pressure on the table frame when assembled. The table further includes a top supported by the table frame.

6 Claims, 3 Drawing Sheets

BACKPACKER'S CAMP TABLE

TECHNICAL FIELD OF THE INVENTION

The present invention relates to tables, and more particularly to a portable and demountable table for use by backpackers, hikers, campers and the like.

BACKGROUND OF THE INVENTION

Backpackers, hikers, campers, scouters, outfitters, hunters, fishermen and other outdoors persons during wilderness hikes, short-duration campouts and other outdoor activities all experience a need for a table for the preparation of food. A primary problem encountered in an outdoor or wilderness setting is keeping one's food off the ground while food is being prepared for cooking. Typically, in a camp setting, a table for food preparation is not available, and the camper will prepare his or her food, protected by aluminum foil or other ground covering spread out over the ground. People walking around the campfire and "kitchen" area inadvertently kick-up dust, leaves and other debris, a portion of which frequently finds its way into the food. Another problem of using the ground as a table stems from ants, beetles and other insects which are drawn to food being prepared on the ground, even when that preparation is done on paper, aluminum foil, plastic or other flexible barriers which might be placed on the ground. A third type of problem experienced in this outdoor "kitchen" occurs when one places a food container on the ground during food preparation because debris temporarily adheres to the bottom of the container. When the container is subsequently held over the food preparation area, the debris often falls off into the food.

A common practice of non-wilderness campers is the use of the top of a chair or ice chest as a food preparation surface or table. However, this practice is awkward and inconvenient. After one has covered the top of the ice chest with food in preparation, generally an item located within the ice chest is then needed. All items located on top of the ice chest must then be moved to the ground, the item desired removed from the ice chest, and the food replaced on the top of the ice chest in order for preparations to continue. This constant maneuvering is quite inconvenient and often deposits debris on the bottom of all items placed on the ground. Again, this debris frequently finds its way into the food or cooking equipment. Additionally, many campers alternatively use the ice chest as a seat and a camp stool as a dining table. Either use necessitates the placement on the ground of all items which have been used during food preparation. This maneuver only ensures that debris and insects have a longer time and an additional opportunity to contaminate the food.

A need has thus arisen for a portable, lightweight and easily assemblable table for the use by a wilderness hiker, camper, hunter or fisherman. Such a portable table must be as lightweight as possible, and have no small parts which might be lost. Additionally, such a table must be as compact as possible for convenient storage in a backpack.

SUMMARY OF THE INVENTION

In accordance with the present invention, a portable table is provided and includes a pair of side members and a pair of end members. Structure is provided for detachably interconnecting the side members and the end members to thereby form a table frame. A plurality of support members are detachably interconnected to the side members for supporting the table frame above a surface. Each of the support members includes first and second ends. The first ends thereof are detachably interconnected to the pair of side members, and the second ends thereof extend to the surface. The support members second ends are spaced apart greater than the length of the end members and greater than the length of the side members for generating a torque pressure on the table frame when assembled. The table further includes a top supported by the table frame.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENT

Figure 1:
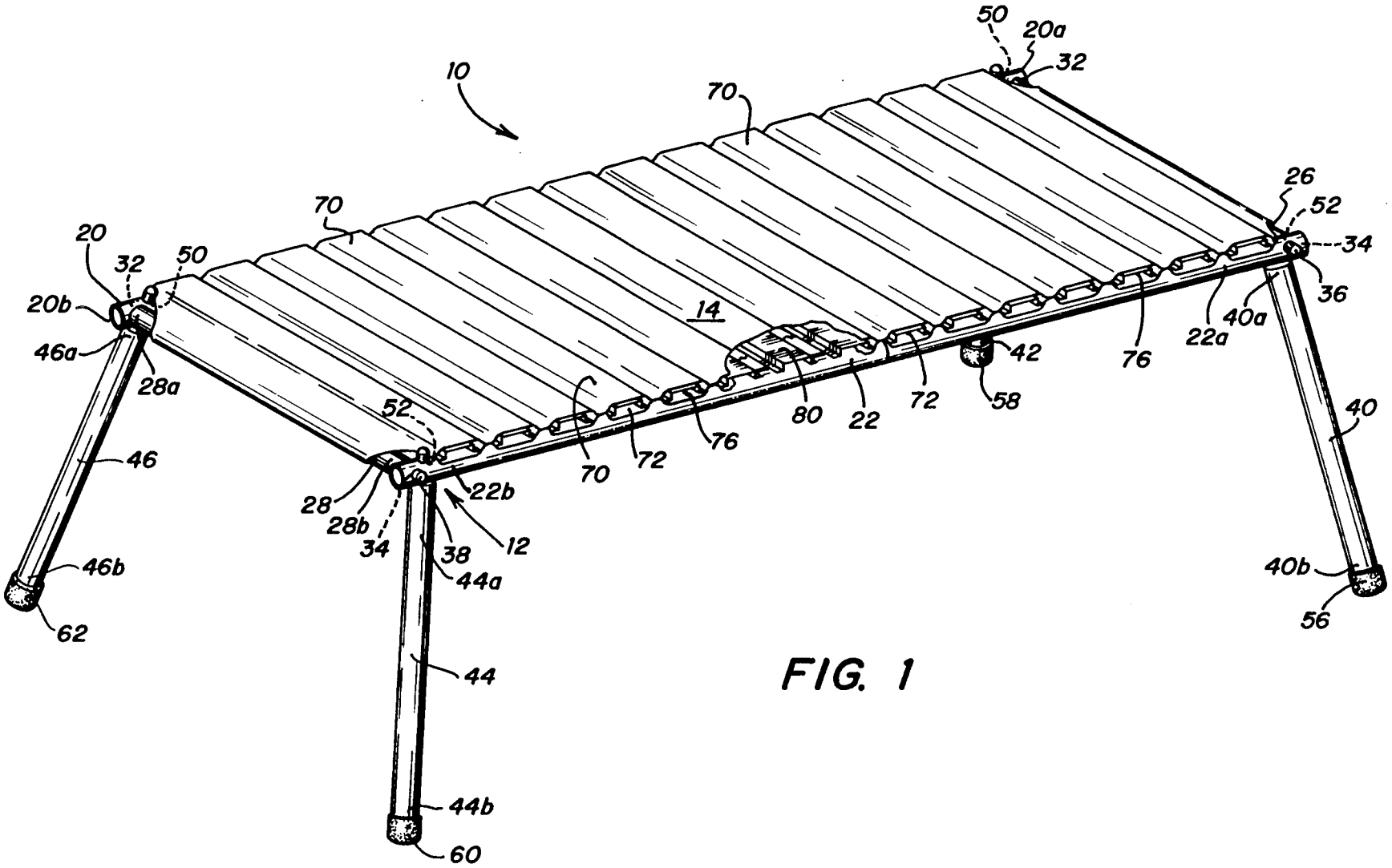
FIG. 1 is a perspective view of the present table.
Figure 2:
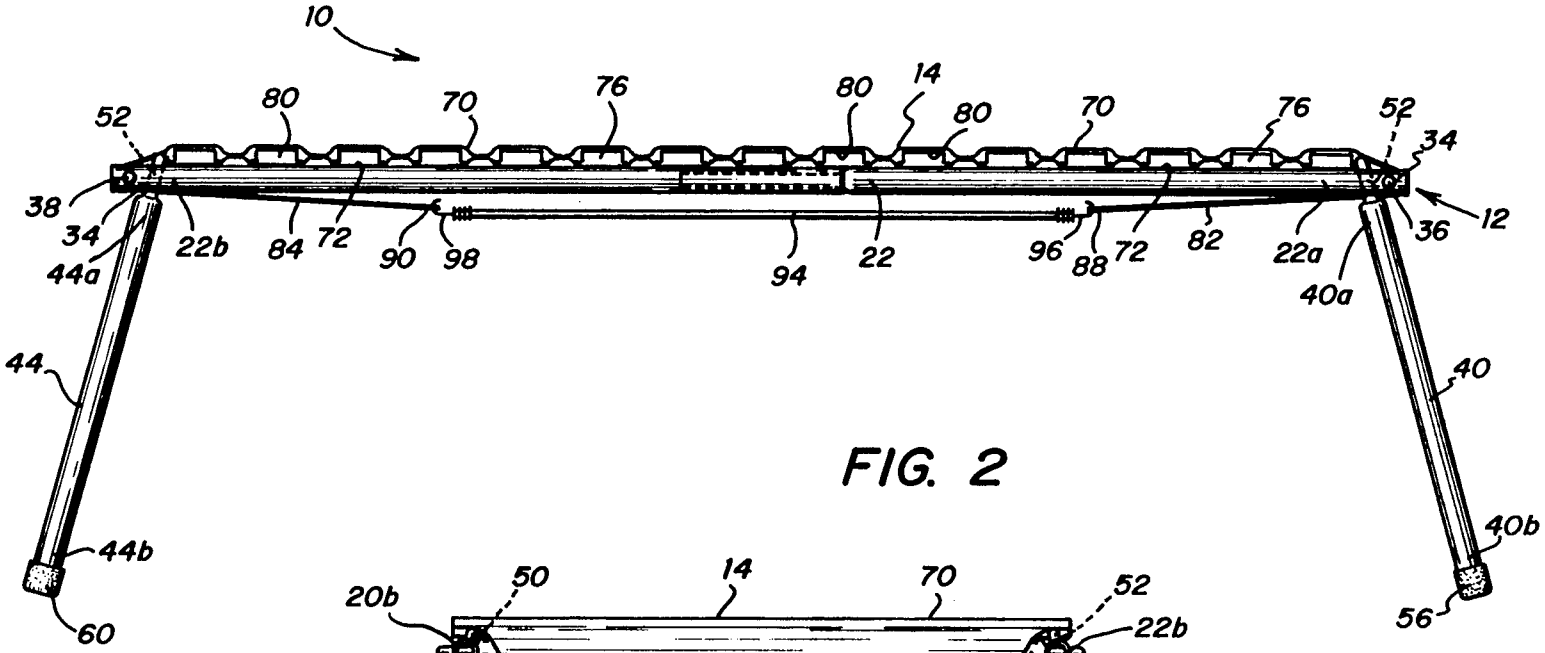
FIG. 2 is a side elevational view of the present table illustrated in FIG. 1.
Figure 3:
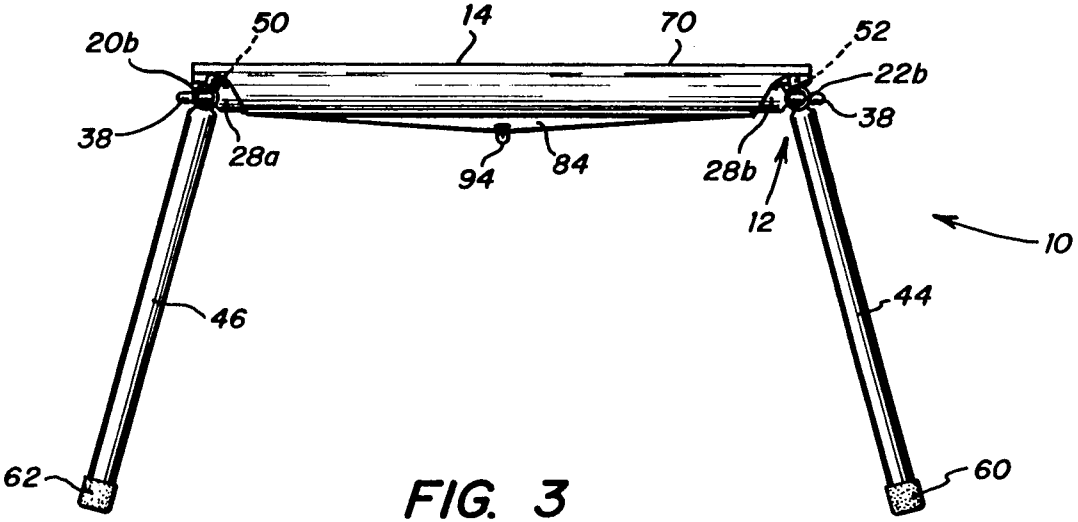
FIG. 3 is an end view of the present table illustrated in FIG. 1.
Figure 4:
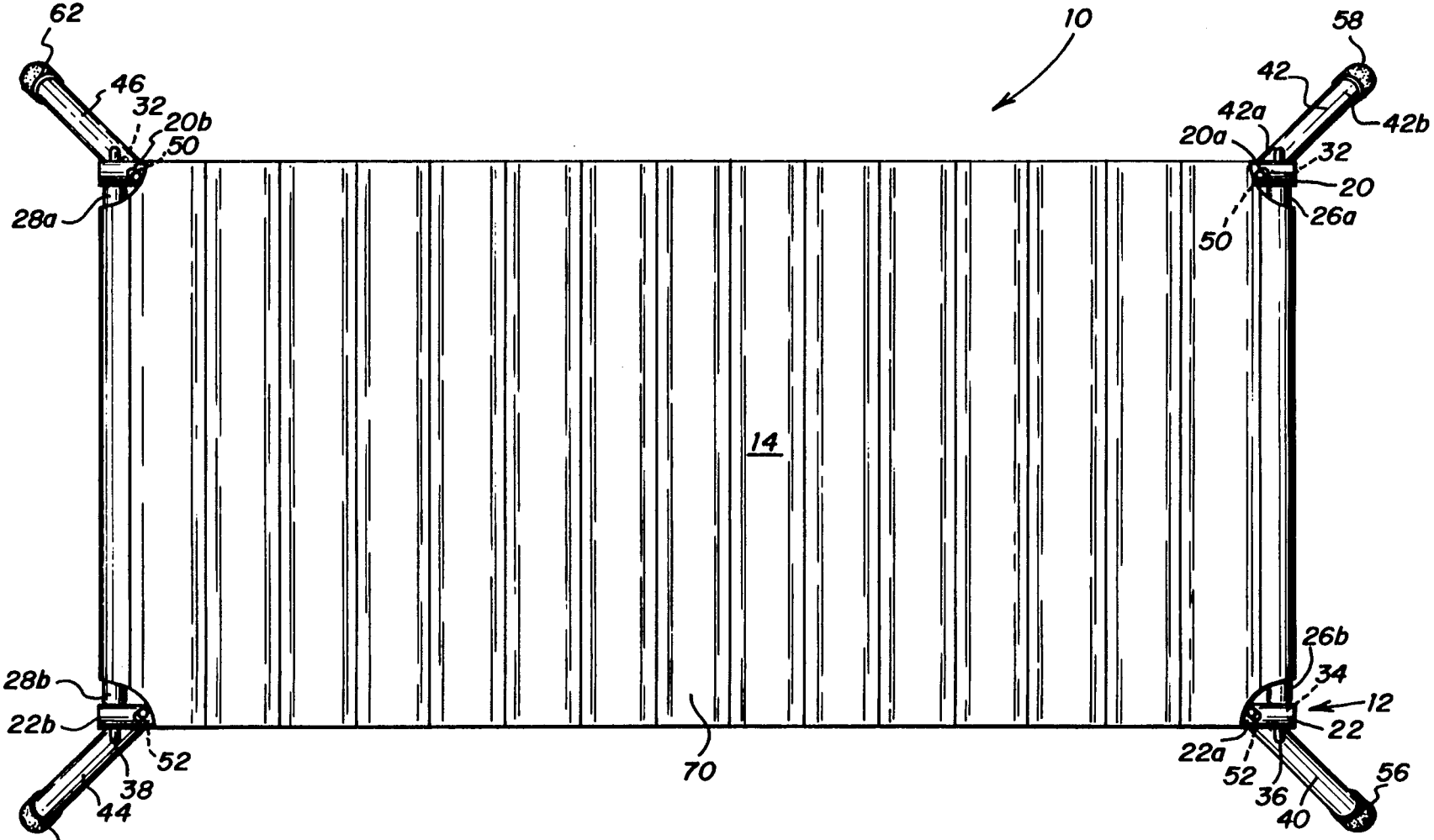
FIG. 4 is a top plan view of the present table illustrated in FIG. 1.

Referring simultaneously to FIGS. 1–4, the table of the present invention is illustrated, and is generally identified by the numeral 10. Table 10 includes a frame, generally identified by the numeral 12 and a top surface 14 supported by frame 12. Table 10 is constructed such that screws, wing nuts or other similar fastening devices are unnecessary. Additionally, the components of frame 12 of table 10 can be easily assembled and compactly stored for ease of handling.

Frame 12 includes a first side member 20 having ends 20*a* and 20*b*, and a second side member 22 having ends 22*a* and 22*b*. Frame 12 further includes a first end member 26 having ends 26*a* and 26*b*, and a second end member 28 having ends 28*a* and 28*b*. Side members 20 and 22 and end members 26 and 28 form a generally rectangular configured frame 12, it being understood that the lengths of side members 20 and 22 and end members 26 and 28 are variable depending upon the overall size of table 10 and area of top surface 14. Additionally, for size considerations, side members 20 and 22 may be composed of multiple inter-fitting sections to reduce the disassembled length of side members 20 and 22. Side members 20 and 22, and end members 26 and 28, may be fabricated of, for example, lightweight tubular aluminum.

Disposed at ends 20*a* and 20*b* of first side member 20 are apertures 32 generally disposed perpendicularly to the length of first side member 20. Disposed at ends 22*a* and 22*b* of second side member 22 are apertures 34. Apertures 34 are disposed generally perpendicular to the length of second side member 22. Ends 26*a* and 26*b* of first end member 26 include reduced diameter portions 36 which are received by apertures 32 and 34 of first side member 20 and second side member 22, respectively. Similarly, second end member 28 includes reduced diameter portions 38 at ends 28*a* and 28*b*. Ends 28*a* and 28*b* are received by apertures 32 and 34 contained within ends 20*b* and 22*b* of first side member 20 and second side member 22, respectively. In this manner, first and second end members 26 and 28 are interconnected to first and second side members 20 and 22 without the use of any extraneous fasteners such as screws, wing nuts or other similar is such to provide a snug frictional fit between ends 26*a* and 26*b* of first end member 26 and ends 28*a* and 28*b* of second end member 28.

Frame 12 of table 10 is supported above the ground through the use of legs 40, 42, 44, and 46. Legs 40 and 42 are disposed adjacent first end member 26, and legs 44 and 46 are disposed adjacent to second end member 28. Legs 40–46 may be comprised of, for example, lightweight tubular aluminum. Legs 40–46 are interconnected to first side member 20 and second side member 22 and are held in a spread configuration to thereby create a torque pressure on first and second end members 26 and 28, and first and second side members 20 and 22 to maintain frame 12 together without the use of any mechanical fastening devices.

Ends 20*a* and 20*b* of first member 20 include an aperture 50. Ends 22*a* and 22*b* of second side member 22 include an aperture 52. Apertures 50 and 52 are diagonally disposed with respect to the length of side members 20 and 22 and are angularly disposed to a horizontal and vertical plane with respect to the longitudinal axis of side members 20 and 22. Leg 40 having ends 40*a* and 40*b* includes a reduced diameter portion at end 40*a* for insertion into aperture 52 of second side member 22 at end 22*a*. Leg 42 having ends 42*a* and 42*b*, includes a reduced diameter portion at end 42*a* for insertion into aperture 50 of first side member 20 at end 20*a*. Leg 44 having ends 44*a* and 44*b*, includes a reduced diameter portion at end 44*a* for insertion into aperture 52 of second side member 22 at end 22*b*. Similarly, leg 46 includes ends 46*a* and 46*b*, having a reduced diameter portion at end 46*a* for insertion into aperture 50 of end 20*b* of first side member 20. Due to the angular disposition of apertures 50 and 52, legs 40–44 are spaced apart and extend such that ends 40*b*, 42*b*, 44*b* and 46*b* extend past the ends of first and second side members 20 and 22 and first and second end members 26 and 28 as clearly illustrated in FIG. 4. In this manner, legs 40–46 are held in a spread configuration creating between first and second side members 20 and 22 and first and second end members 26 and 28 a torque pressure which maintains frame 12 integrally connected as weight is placed upon top surface 14 of table 10.

Ends 40*b*, 42*b*, 44*b*, and 46*b* of legs 40–46 include end caps 56, 58, 60, and 62, respectively to improve stability of table 10 and to reduce penetration of legs 40–46 into the ground.

Top surface 14 of table 10 comprises a double layer of, for example, synthetic fabric 70 and 72 which is fastened by, for example, stitching or gluing to create a plurality of compartments 76. Inserted within compartments 76 are stiffening devices 80, which may comprise, for example, aluminum channels having a "C"-cross section. Stiffening devices 80 span the distance between first and second side members 20 and 22 and provide stiffness and load carrying capability for top surface 14. Top surface 14 includes extension members 82 and 84 which wrap around first and second end members 26 and 28, respectively, when top surface 14 is assembled to frame 12. Extension members 82 and 84 include apertures 88 and 90, respectively. Interconnecting extension members 82 and 84 of top surface 14 is an elastomeric cord 94. Elastomeric cord 94 includes hooks 96 and 98 which are positioned within apertures 88 and 90 for fastening top surface 14 to frame 12.

For storage and transportation of table 10, top surface 14 is removed, and frame 12 is disassembled. Stiffening devices 80 may be removed from compartments 76. Stiffening devices 80 can be bundled with first and second side members 20 and 22, first and second end members 26 and 28, and legs 44–46 by wrapping top surface 14 around these members and encircling elastomeric cord 94 around the entire bundle. The bundle can then be inserted into a stuff sack for ease of handling and storage.

It therefore can be seen that the present table comprises a lightweight, compact, portable and demountable table designed for convenient assembly, compact storage and sanitary, all-weather use for the outdoors person. The table of the present invention can be easily and quickly assembled and disassembled without the use of mechanical fastening devices, and provides for a stable and rigid top.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A portable table, comprising:

a first tubular side member having first and second ends thereof, and including first and second apertures adjacent to each of said ends, said first apertures being perpendicularly disposed to the longitudinal axis of said first tubular side member;

a second tubular side member having first and second ends thereof, and including first and second apertures adjacent each of said ends, said first apertures being perpendicularly disposed to the longitudinal axis of said second tubular side member;

a first tubular end member having a first diameter and first and second ends, said first and second ends having a projection of a second diameter less than said first diameter for engagement with said first apertures of said first ends of said first and second tubular side members;

a second tubular end member having a first diameter and first and second ends, said first and second ends having a projection of a second diameter less than said first diameter for engagement with said first apertures of said second ends of said first and second tubular side members;

said members forming a table frame;

first and second tubular support members for supporting said first tubular end member above a surface, each of said first and second tubular support members having a first diameter and first and second ends, said first ends having a projection of a second diameter less than said first diameter for engagement with said second apertures of said first ends of said first and second tubular side members, said second ends of said first and second tubular support members extending to the surface and extending beyond said first ends of said first and second tubular side members and beyond said first and second ends of said first tubular end member;

third and fourth tubular support members for supporting said second tubular end member above the surface, said third and fourth tubular support members each having a first diameter and first and second ends, said first ends having a projection of a second diameter less than said first diameter for engagement with said second apertures of said second ends of said first and second tubular side members, said second ends of said third and fourth tubular support members extending to the surface and extending beyond said second ends of said first and second tubular side members and beyond said first and second ends of said second tubular end member;

said first and third tubular support members generating a first torque pressure on said first tubular side member and said second and fourth tubular support members generating a second torque pressure on said second tubular side member in a direction opposite said first torque pressure, such that said first and second tubular side members generate a force applied to said first and second tubular end members for maintaining said side and end members interconnected to form said table frame and for further maintaining said tubular support members interconnected to said first and second tubular side members when said table frame is assembled; and a flexible top member supported by said table frame.

2. The portable table of claim 1 and further including means for covering said second ends of said tubular support members.

3. The portable table of claim 1 wherein said flexible top member includes a plurality of compartments and means removably disposed within said compartments and extending between and supported by said tubular side members for providing stiffening and supporting members for said flexible top member.

4. The portable table of claim 3 wherein said flexible top member includes first and second ends disposed adjacent to said first and second tubular end members, and means for attaching said first end to said second end of said flexible top member.

5. The portable table of claim 4 wherein said means for attaching said first end to said second end of said flexible top member includes an elastomeric cord.

6. The portable table of claim 3 wherein said means removably disposed within said plurality of compartments includes channels having a C-shaped cross section.

* * * * *

UNITED STATES PATENT AND TRADEMARK OFFICE

CERTIFICATE OF CORRECTION

PATENT NO. : 5,056,439

DATED : OCTOBER 15, 1991

INVENTOR(S) : WILLIAM G. HODGE, JR., WILLIAM G. HODGE, III

It is certified that error appears in the above-identified patent and that said Letters Patent is hereby corrected as shown below:

Column 3, line 5, following "similar" insert -- fastening devices.

The diameter of apertures 32 and 34 --.

Signed and Sealed this

Twenty-third Day of March, 1993

*Attest:*

STEPHEN G. KUNIN

*Attesting Officer*

*Acting Commissioner of Patents and Trademarks*